US008246151B2

(12) United States Patent
Nakamura

(10) Patent No.: US 8,246,151 B2
(45) Date of Patent: Aug. 21, 2012

(54) LIQUID SUPPLY DEVICES

(75) Inventor: Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 252 days.

(21) Appl. No.: 12/836,452

(22) Filed: Jul. 14, 2010

(65) Prior Publication Data

US 2011/0012953 A1 Jan. 20, 2011

(30) Foreign Application Priority Data

Jul. 16, 2009 (JP) ..... 2009-167363

(51) Int. Cl.
*B41J 2/175* (2006.01)
*B41J 2/195* (2006.01)
*B41J 29/393* (2006.01)

(52) U.S. Cl. ..... 347/86; 347/7; 347/19

(58) Field of Classification Search ..... None
See application file for complete search history.

(56) References Cited

U.S. PATENT DOCUMENTS

2009/0179925 A1 7/2009 Sugahara
2009/0179926 A1 7/2009 Sugahara
2009/0184991 A1 7/2009 Sugahara

FOREIGN PATENT DOCUMENTS

JP 2000-190517 A 7/2000
JP 2008-087311 A 4/2008

*Primary Examiner* — Stephen Meier
*Assistant Examiner* — Tracey McMillion
(74) *Attorney, Agent, or Firm* — Baker Botts L.L.P.

(57) ABSTRACT

A liquid supply device includes a liquid cartridge having a liquid chamber that stores a liquid, a cartridge mounting portion, and a level detector that detects a position of a liquid surface of the liquid stored in the liquid chamber. The position of the liquid surface of the liquid is detected to be at one of at least three liquid surface levels. The liquid supply device also includes a determiner that determines that the liquid supply device is in an abnormal state when the position of the liquid surface of the liquid moves up by two or more liquid surface levels and determines that the liquid supply device is not in the abnormal state when the liquid surface of the liquid moves up by one or fewer liquid surface level.

10 Claims, 13 Drawing Sheets

LIQUID SUPPLY DEVICES

CROSS REFERENCE TO RELATED APPLICATION

The present application claims priority to and the benefit of Japanese Patent Application No. 2009-167363, which was filed on Jul. 16, 2009, the disclosure of which is incorporated herein by reference in its entirety.

BACKGROUND OF THE INVENTION

1. Field of the Invention

The present invention relates to liquid supply devices configured to supply liquid.

2. Description of Related Art

A known liquid supply device has a cartridge mounting portion and a liquid cartridge configured to removably mount to the cartridge mounting portion. The liquid cartridge mounted in the cartridge mounting portion is configured to supply liquid to an object. The liquid supply device has a detector configured to detect the amount of liquid stored in the liquid cartridge in order to notify a user of how much liquid remains in the liquid cartridge and notify the user if the liquid cartridge needs to be replaced.

Another known liquid supply device, i.e., the liquid supply device described in JP-A-2008-87311, is configured to detect the amount of liquid stored in a liquid cartridge. The liquid cartridge has a pivotable member having a float at one end thereof and a detection portion at the other end thereof. The pivotable member is pivotally supported in the liquid cartridge. The liquid supply device is configured to detect the amount of liquid stored in the liquid cartridge by detecting, with an optical sensor, the movement of the detection portion connected indirectly to the float member which moves with the change in the amount of liquid stored in the liquid cartridge.

SUMMARY OF THE INVENTION

A technical advantage of the present invention is that a liquid supply device determines more accurately that the liquid supply device is in an abnormal state. According to an embodiment of the present invention, a liquid supply device comprises a liquid cartridge comprising a liquid chamber configured to store a liquid therein, a cartridge mounting portion, wherein the liquid cartridge is configured to removably mount to the cartridge mounting portion, a level detector configured to detect a position of a liquid surface of the liquid stored in the liquid chamber, wherein the position of the liquid surface of the liquid is detected to be at one of at least three liquid surface levels, and a determiner configured to determine that the liquid supply device is in an abnormal state when the determiner determines that the position of the liquid surface of the liquid detected by the level detector has moved by two or more liquid surface levels in a particular direction away from a bottom surface of the liquid chamber, and the determiner is configured to determine that the liquid supply device is not in the abnormal state when the determiner determines that the position of the liquid surface of the liquid detected by the level detector has moved by one or fewer liquid surface level in the particular direction.

According to another embodiment of the present invention, a liquid supply device comprises a liquid cartridge comprising a liquid chamber configured to store a liquid therein, a cartridge mounting portion, wherein the liquid cartridge is configured to removably mount to the cartridge mounting portion, a level detector configured to detect a position of a liquid surface of the liquid stored in the liquid chamber, wherein the position of the liquid surface of the liquid is detected to be at one of at least three liquid surface levels, and a determiner configured to determine that the liquid supply device is in an abnormal state when the determiner determines that the position of the liquid surface detected by the level detector has moved by two or more liquid surface levels passing by at least one intermediate liquid surface level in a downward direction toward a bottom surface of the ink chamber without determining the position of the liquid surface at the at least one intermediate liquid surface level, and to determine that the liquid supply device is not in the abnormal state when the position of the liquid surface detected by the level detector has moved by one or fewer liquid surface level in the downward direction.

According to yet another embodiment of the present invention, a liquid supply device comprises a liquid cartridge comprising a liquid chamber configured to store a liquid therein, a cartridge mounting portion, wherein the liquid cartridge is configured to removably mount to the cartridge mounting portion, a level detector configured to detect a position of a liquid surface of the liquid stored in the liquid chamber, wherein the position of the liquid surface of the liquid is detected to be at one of at least three liquid surface levels, and a controller configured to perform a first process when the controller determines that the position of the liquid surface detected by the level detector has moved by two or more liquid surface levels in a particular direction away from a bottom surface of the liquid chamber and configured to perform a second process when the controller determines that the position of the liquid surface detected by the level detector has moved by one or fewer liquid surface level in the particular direction, wherein the second process is distinct from the first process.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Embodiments of the present invention, and their features and advantages, may be understood by referring to FIGS. 1-13, like numerals being used for like corresponding parts in the various drawings.

Figure 1:
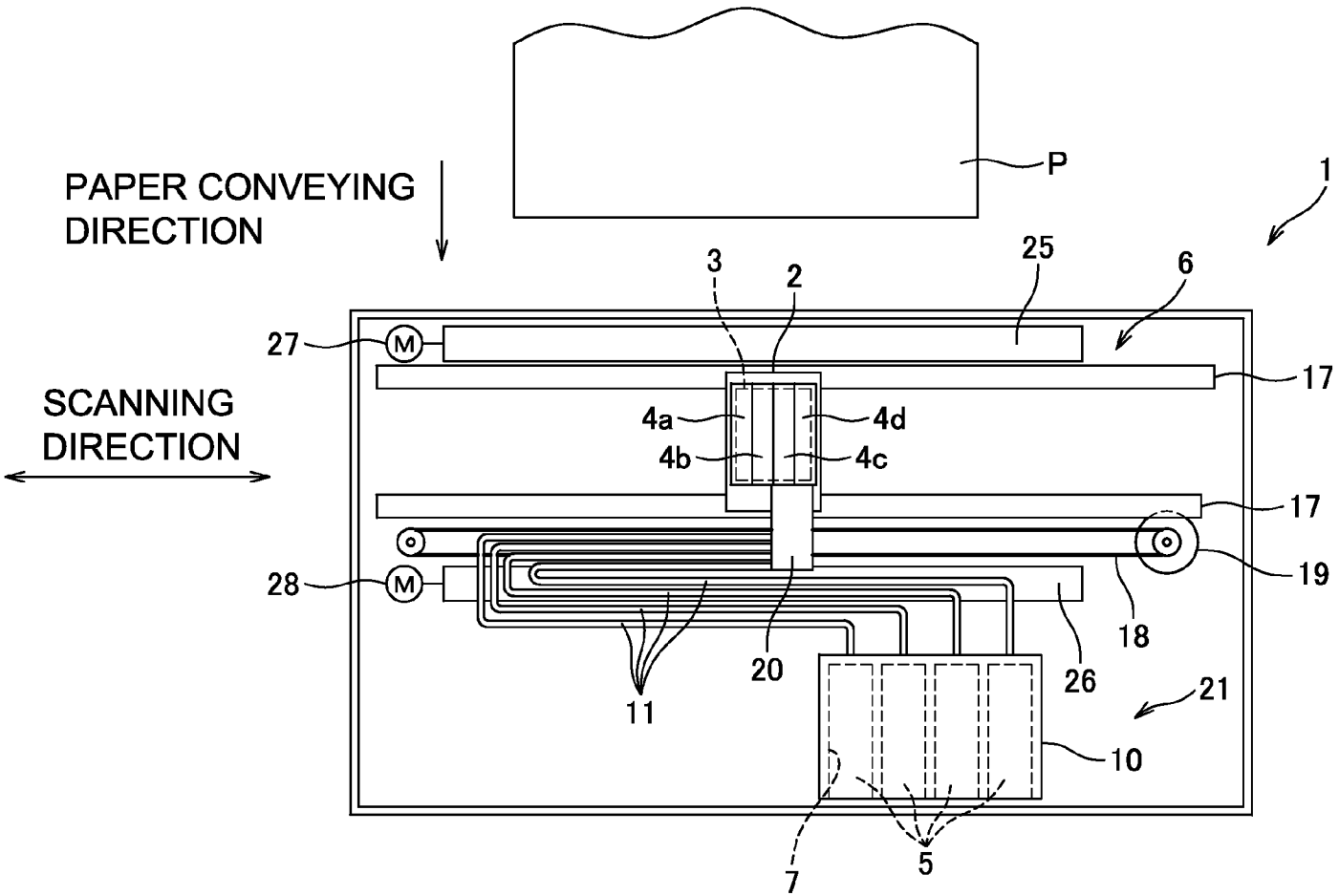
FIG. 1 is a schematic plan view of a printer according to an embodiment of the invention.
Figure 9:
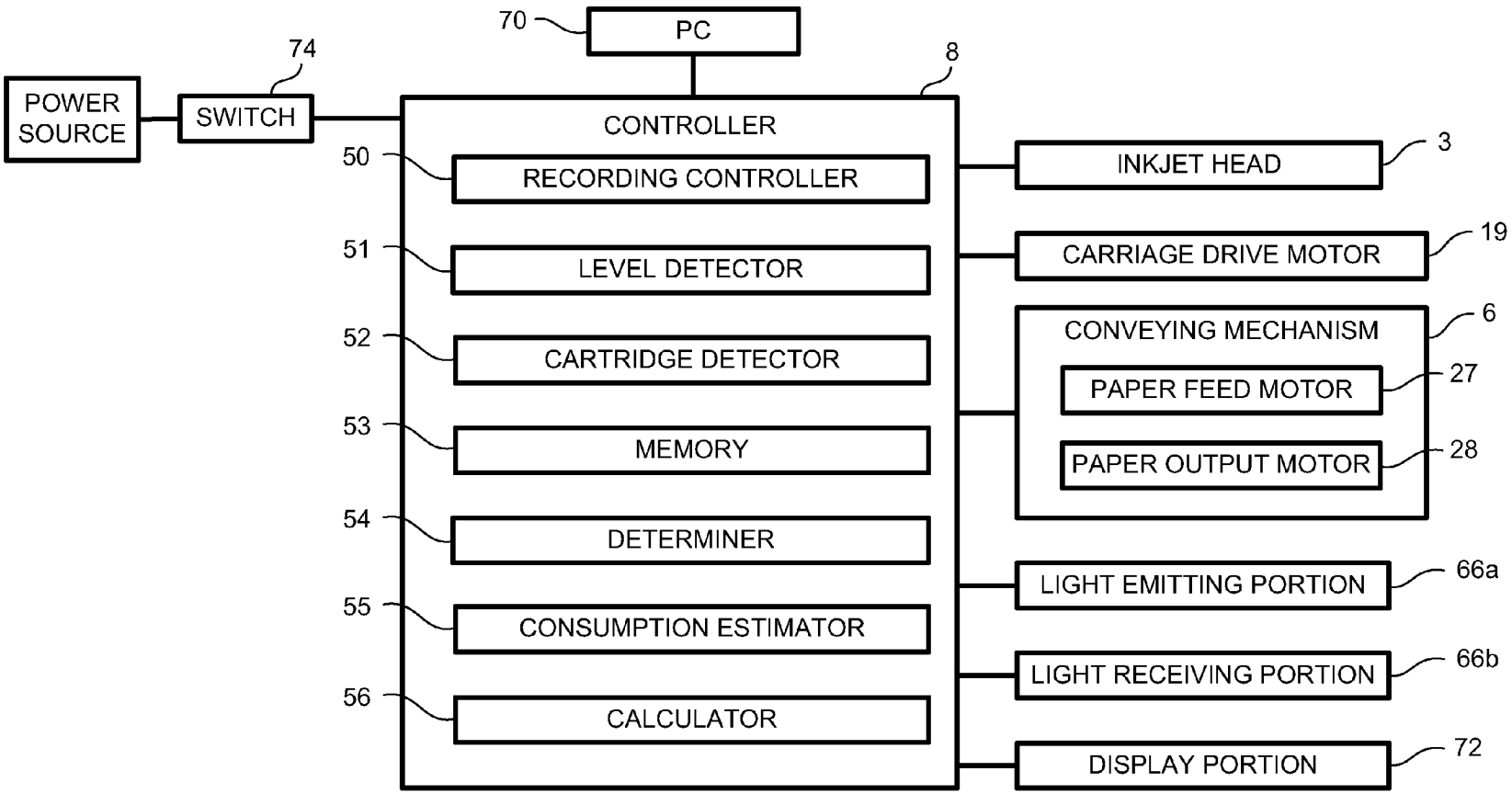
FIG. 9 is a block diagram of a controller of the printer according to an embodiment of the invention.

Referring to FIG. 1, a printer 1 may comprise a carriage 2 configured to reciprocate along a scanning direction, e.g., a left-right direction of FIG. 1, a liquid ejecting head, e.g., an inkjet head 3, and sub-tanks 4*a*-4*d* mounted to carriage 2, an ink supply portion 21 comprising cartridge mounting portions 7 to which liquid cartridges, e.g., ink cartridges 5 storing ink, may removably mount, a conveying mechanism 6 configured to convey a recording sheet P in a paper conveying direction which is perpendicular to the scanning direction, and a controller 8, as shown in FIG. 9, configured to control the operation of the printer 1.

Carriage 2 may reciprocate along two guide shafts 17 extending parallel to each other in the scanning direction. An endless belt 18 may connect to carriage 2. When the endless belt 18 is driven by a carriage drive motor 19, carriage 2 may move in the scanning direction with the movement of endless belt 18.

Inkjet head 3 and four sub-tanks 4*a*-4*d* may be mounted on carriage 2. Inkjet head 3 may comprise a plurality of nozzles formed in a lower surface of inkjet head 3 for ejecting ink. Four sub-tanks 4*a*-4*d* may align in the scanning direction. A tube joint 20 may be integrally formed with four sub-tanks 4*a*-4*d*. Four sub-tanks 4*a*-4*d* and four ink cartridges 5 mounted to cartridge mounting portions 7 may be in fluid communication via flexible tubes 11, which may be connected to tube joint 20.

Four ink cartridges 5 may store color inks, e.g., black, yellow, cyan, and magenta, respectively. Ink cartridges 5 may be configured to be inserted into four cartridge mounting portions 7 provided in a holder 10 of ink supply portion 21, and thereby be removably mounted in holder 10.

The inks of four colors stored in four ink cartridges 5 may be supplied through four tubes 11 to four sub-tanks 4*a*-4*d*, and may be temporarily stored in four sub-tanks 4*a*-4*d*, and thereafter supplied to inkjet head 3. Inkjet head 3 may reciprocate in the scanning direction with carriage 2 and eject ink from the nozzles formed in the lower surface of inkjet head 3 onto a recording sheet P. Recording sheet P may be conveyed in the paper conveying direction by conveying mechanism 6.

Conveying mechanism 6 may comprise a paper feed roller 25 positioned on the upstream side in the paper conveying direction with respect to inkjet head 3 and a paper output roller 26 positioned on the downstream side in the paper conveying direction with respect to inkjet head 3. Paper feed roller 25 and paper output roller 26 may be rotationally driven by a paper feed motor 27 and a paper output motor 28, respectively. Conveying mechanism 6 may be configured to feed recording sheet P using paper feed roller 25 and paper output roller 26. Paper feed roller 25 may feed recording sheet P toward inkjet head 3 and paper output roller 26 may output recording sheet P, on which images, characters, or both, have been recorded by inkjet head 3, from underneath inkjet head 3.

Figure 3A:
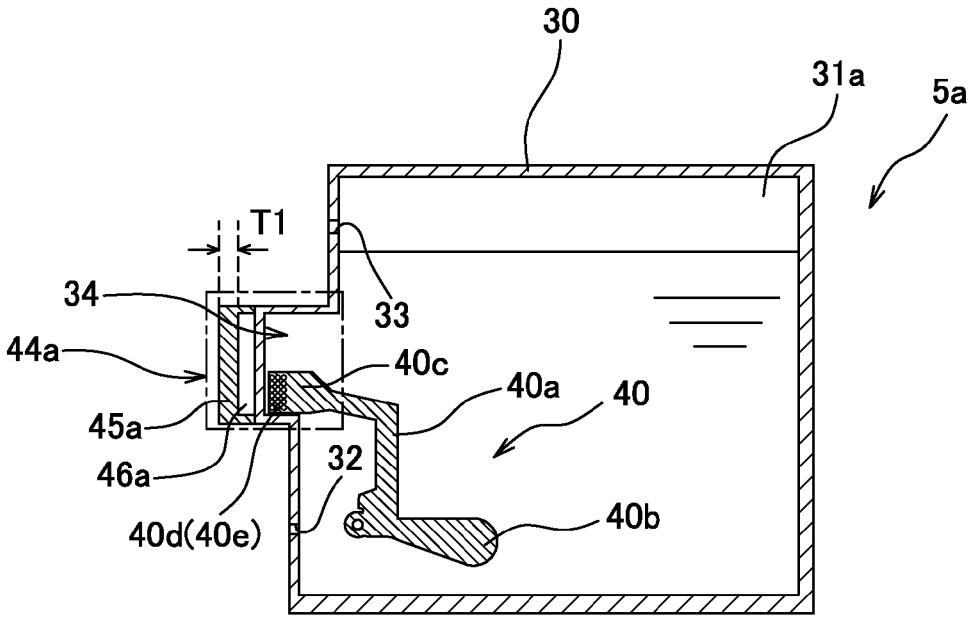
FIG. 3A is a vertical cross-sectional view of a first cartridge according to an embodiment of the invention.
Figure 3B:
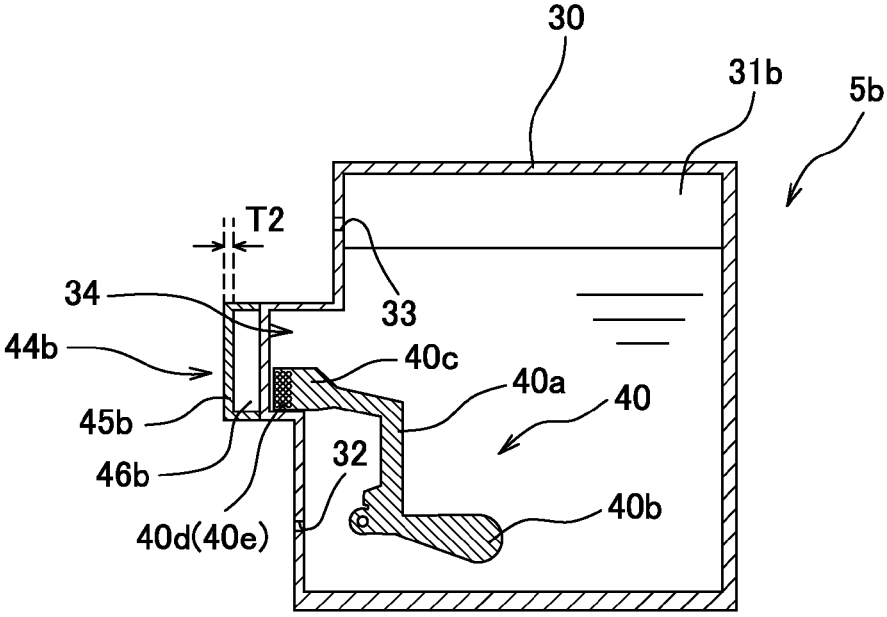
FIG. 3B is a vertical cross-sectional view of a second cartridge according to an embodiment of the invention.

Ink cartridge 5 may be configured to removably mount to cartridge mounting portion 7 of holder 10 in a mounting direction. A direction opposite the mounting direction may be a removing direction. In the following description, "front" and "back" mean "front" and "back" in the mounting direction. Each of the mounting direction and the removing direction may be a horizontal direction. Two types of ink cartridges 5*a* and 5*b*, e.g., a first cartridge 5*a* and a second cartridge 5*b*, may be selectively mounted to the same cartridge mounting portion 7 of holder 10. Ink cartridges 5*a* and 5*b* may store the same color of ink. Ink cartridges 5*a* and 5*b* may have ink chambers 31*a* and 31*b*, with different lengths in the horizontal direction and may have different ink-storing capacities, as shown in FIGS. 3A and 3B. The ink-storing capacity of second cartridge 5*b* may be less than the ink-storing capacity of first cartridge 5*a*. The initial amount of ink stored in ink chamber 31*b* of second cartridge 5*b* may be less than the initial amount of ink stored in ink chamber 31*a* of first cartridge 5*b*. First cartridge 5*a* and second cartridge 5*b* may have substantially similar structures.

Figure 2:
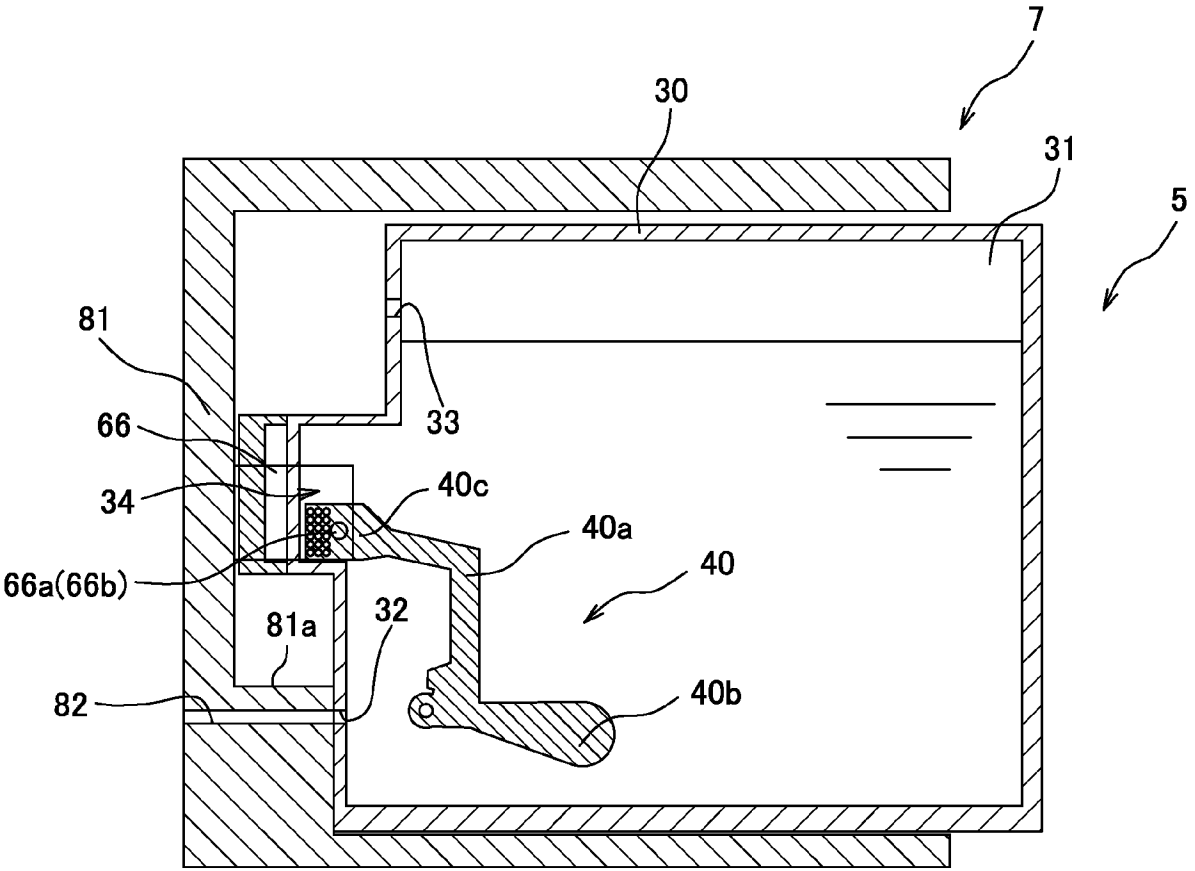
FIG. 2 is a vertical cross-sectional view of an ink cartridge and a cartridge mounting portion of a holder according to an embodiment of the invention.

Referring to FIGS. 2 to 3B, ink cartridge 5 may comprise a cartridge main body 30 configured to store ink and a sensor arm 40 for detecting the amount of ink stored in cartridge main body 30, e.g., for detecting the position of ink surface stored in cartridge main body 30. Cartridge main body 30 may comprise a transparent or a semi-transparent material, e.g., a synthetic resin material, and may have a hollow, substantially rectangular parallelepiped shape. Cartridge main body 30 may comprise an ink chamber 31 configured to store ink therein, an ink supply hole 32 formed in a lower portion of a front end of the cartridge main body 30, an air intake hole 33 formed in an upper portion of the front end of cartridge main body 30, and a detection portion 34 positioned between ink supply hole 32 and air inlet hole 33 at the front end of cartridge main body 30 projecting forward therefrom. When ink cartridge 5 is mounted to cartridge mounting portion 7 of holder 10, a lower portion of detection portion 34 may be positioned between a light emitting portion 66*a* and a light receiving portion 66*b* of an optical sensor 66 provided in cartridge mounting portion 7.

Sensor arm 40 may comprise an arm portion 40*a* pivotally supported by cartridge main body 30 in ink chamber 31, a float 40*b* positioned at one end of arm portion 40*a* and configured to move up and down based on a change in the ink surface in ink chamber 31, and a movable member e.g., a light blocking plate 40*c*, positioned at the other end of arm portion 40*a*.

Light blocking plate 40*c* may be positioned in detection portion 34. Light blocking plate 40*c* may move up and down relative to cartridge main body 30 in detection portion 34 when float 40*b* moves up and down in response to the change in the ink surface in ink chamber 31. When ink cartridge 5 is positioned in cartridge mounting portion 7 of holder 10, light blocking plate 40*c* may be configured to block light emitted from light emitting portion 66*a* toward light receiving portion 66*b*.

When ink chamber 31 stores a sufficient amount of ink therein, a buoyancy force may act on float 40*b* and arm portion 40*a* in the counterclockwise direction, as shown in FIGS. 3A and 3B, and light blocking plate 40*c* may contact a bottom surface of detection portion 34. When the amount of ink stored in ink chamber 31 decreases and float 40*b* emerges from the ink surface in ink chamber 31, the buoyancy force acting on arm portion 40*a* and float 40*b* may decrease. When the amount of ink stored in the ink chamber 31 decreases further and the ink surface lowers, arm portion 40*a* may pivot in the clockwise direction, as shown in FIGS. 3A and 3B, and float 40*b* may come contact a bottom surface of ink chamber 31.

Figure 4A:
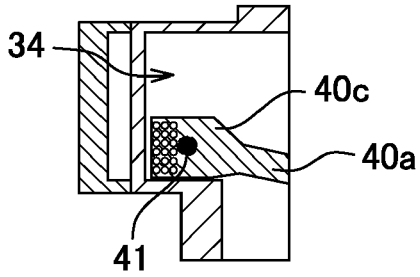
FIG. 4A is an enlarged view of a portion enclosed by dashed line in FIG. 3A, in which an ink surface is positioned above a float.
Figure 4B:
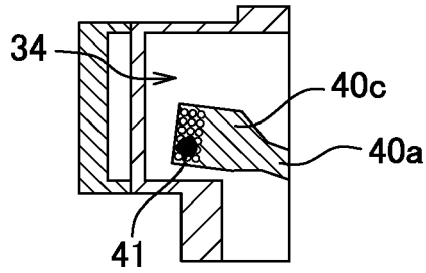
FIG. 4B is the enlarged view of FIG. 4A, in which the float emerges from the ink surface and a light blocking plate moves slightly.
Figure 4C:
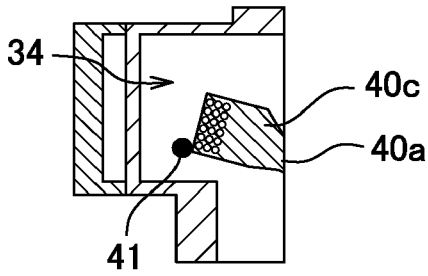
FIG. 4C is the enlarged view of FIG. 4A, in which the light blocking plate moves further beyond the position of the light blocking plate in FIG. 4B.

Referring to FIGS. 4A-4C, a black dot indicates a position and a size of a light emitting port 41 of light emitting portion 66*a* when ink cartridge 5 is mounted to cartridge mounting portion 7. Light emitted through light emitting port 41 of light emitting portion 66*a* may project toward light receiving portion 66*b*.

As shown in FIGS. 3A-4C, light blocking plate 40*c* may comprise an opening-formed portion 40*d* having a plurality of fine openings 40*e* formed therein. Openings 40*e* may be formed through light blocking plate 40*c* in a direction perpendicular to a surface of blocking plate 40*c*, e.g., a direction substantially parallel to the optical axis of the light emitted from light emitting portion 66*a*. Each opening 40*e* may have a circular cross-sectional shape in a cross-sectional plane perpendicular to the optical-axis direction. Openings 40*e* may be evenly distributed and arranged in a reticular pattern in a region from an upper end to a lower end of the front half of light blocking plate 40*c*, e.g., left half as shown in FIGS. 3A-4C. Light directed to opening-formed portion 40*d* may pass through light blocking plate 40*c* through openings 40*e*. A diameter of the cross-section of each opening 40*e* may be less than a diameter of light emitting port 41 of light emitting portion 66*a*, and an average interval between openings 40*e* may be less than the diameter of the light emitting port 41 of light emitting portion 66*a*.

Figure 5:
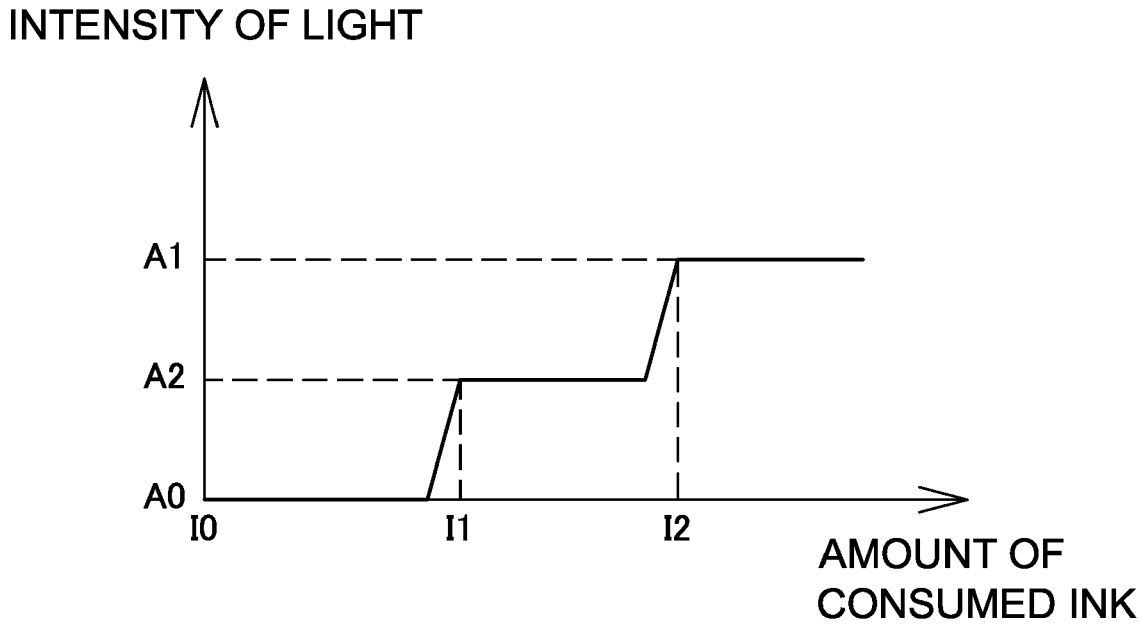
FIG. 5 is a graph illustrating a change in intensity of light received by a light receiving portion when the light blocking plate of FIGS. 4A-4C moves relative to a light emitting port of a light emitting portion.

Referring to FIG. 5, a horizontal axis of a graph indicates an amount of consumed ink, e.g., an amount of ink supplied from ink chamber 31, and a vertical axis of the graph indicates the intensity of light received by light receiving portion 66*b*. Amounts of consumed ink I0, I1, and I2 may correspond to amounts of consumed ink when light blocking plate 40*c* is positioned in FIGS. 4A, 4B, and 4C, respectively.

Referring to FIGS. 5 and 4A, when the amount of consumed ink is I0, e.g., when ink has not been consumed from ink chamber 31, light emitting port 41 may overlap a portion of light blocking plate 40*c* other than opening-formed portion 40*d* in the optical-axis direction, and the light may be blocked by light blocking plate 40*c*. As such, light receiving portion 66*b* may not receive light, and the intensity of light received by light receiving portion 66*b* may be A0. Referring to FIGS. 4C and 5, when the amount of consumed ink is I2, the light may not be blocked by light blocking plate 40*c*, and the intensity of light received by light receiving portion 66*b* may be A1. Referring to FIGS. 5 and 4B, when the amount of consumed ink is I1, light emitting port 41 may overlap opening-formed portion 40*d* of light blocking plate 40*c* in the optical-axis direction, and the light may pass through light blocking plate 40*c* through openings 40*e*. Because the diameter of each opening 40*e* is less than the diameter of light emitting port 41, part of the light may be blocked by a region of light blocking plate 40*c* where openings 40*e* are not formed. As such, when the amount of consumed ink is I1, the intensity of light received by light receiving portion 66*b* may be A2. When the intensity of light received by light receiving portion 66*b* is A1, ink cartridge 5 may be in a near-empty state, e.g., ink cartridge 5 stores a small amount of ink.

With the configuration of sensor arm 40, the intensity of light received by light receiving portion 66*b* may change twice according to the amount of ink stored in ink chamber 31. The amount of ink stored in ink chamber 31 may be divided into three levels, e.g., ink-amount levels, such that the amount of ink stored in ink chamber 31 may be detected in three steps. In other words, the position of the ink surface in ink chamber 31 may be divided into three levels, e.g., three ink surface levels, such that the position of the ink surface in ink chamber 31 may be detected in three steps.

Referring to FIGS. 3A and 3B, the two types of ink cartridges 5*a* and 5*b* may comprise light blocking members 44*a* and 44*b* having different shapes, respectively. Referring to FIG. 3A, first ink cartridge 5*a* may comprise a light blocking member 44*a*. Light blocking member 44*a* may comprise a light blocking plate 45*a* having a predetermined thickness T1 in the mounting direction and positioned at a front portion of detection portion 34. A gap 46*a* may be formed between light blocking plate 45*a* and detection portion 34 in the mounting direction. Referring to FIG. 3B, second ink cartridge 5*b* may comprise a light blocking member 44*b*. Light blocking member 44*b* may comprise a light blocking plate 45*b* having a predetermined thickness T2 in the mounting direction and positioned at a front portion of detection portion 34. A gap 46*b* may be formed between light blocking plate 45*b* and detection portion 34 in the mounting direction. Thickness T1 of light blocking plate 45*a* of first cartridge 5*a* may be greater than thickness T2 of light blocking plate 45*b* of second cartridge 5*b*.

The two types of light blocking plates 45*a* and 45*b* may temporarily block light of optical sensor 66 provided in cartridge mounting portion 7 during the mounting of ink cartridge 5 to cartridge mounting portion 7. Because the two types of light blocking plates 45*a* and 45*b* differ in thicknesses in the mounting direction, a period of time during which the light is blocked may vary in the mounting of the two types of ink cartridges. Based on the period of time during which the light is blocked, controller 8 may determine the type of ink cartridge 5 which is being mounted to cartridge mounting portion 7, e.g., determine whether ink cartridge 5 is first cartridge 5*a* or second cartridge 5*b*.

Figure 6:
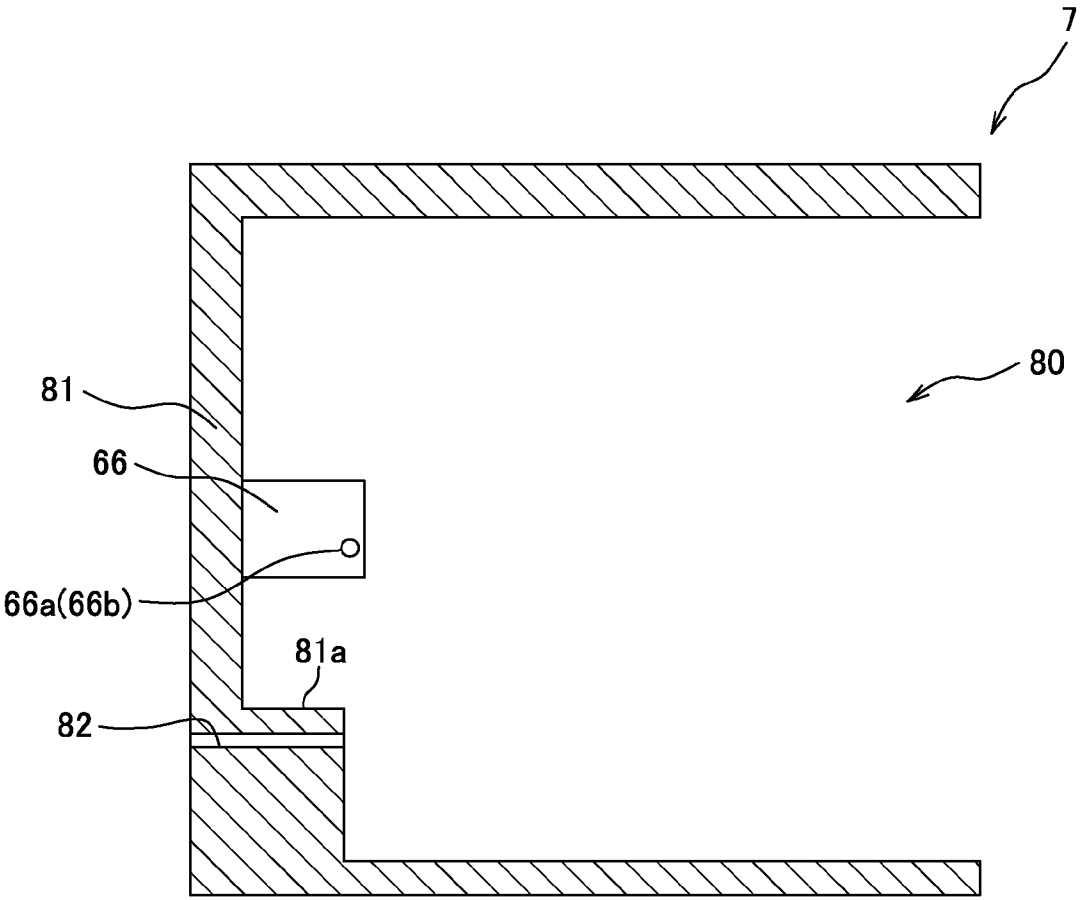
FIG. 6 is a vertical cross-sectional view of the cartridge mounting portion of the holder of FIG. 2.

Referring to FIG. 1, holder 10 may comprise four cartridge mounting portions 7 aligned in the scanning direction and configured to receive four ink cartridges 5 therein. Referring to FIGS. 2 and 6, cartridge mounting portion 7 of holder 10 may comprise a cartridge chamber 80. A front portion of cartridge chamber 80 may be bounded by a front wall 81 of holder 10 and cartridge chamber 80 may be exposed to an exterior of cartridge mounting portion 7 at a back portion of holder 10 opposite front wall 81 via an opening formed through the back portion of holder 10. Cartridge mounting portion 7 may comprise an ink outlet 82 formed through front wall 81 and optical sensor 66 positioned at front wall 81.

Ink cartridge 5 may be configured to be inserted into cartridge chamber 80 through the opening at the back portion of holder 10. A lower portion of front wall 81 may comprise a projecting portion 81*a* projecting backward relative to an upper portion of front wall 81. Ink outlet 82 may be formed through projecting portion 81*a*. An ink tube may communicate with ink outlet 82, which may project backward from projecting portion 81*a*. Ink outlet 82 may be in communication with inkjet head 3 via flexible tube 11, as shown in FIG. 1. Optical sensor 66 may be positioned at a middle portion of front wall 81 in the vertical direction, and may comprise light emitting portion 66*a* and light receiving portion 66*b* facing each other with a predetermined distance therebetween. The intensity of light received by light receiving portion 66*b* may change according to the position of light blocking plate 40*c* of ink cartridge 5 mounted to cartridge mounting portion 7. Optical sensor 66 may be configured to output a signal to controller 8 according to the intensity of the light received.

The output signal of optical sensor 66 may be used for detecting the mounting of ink cartridge 5 in cartridge mounting portion 7, determining the type of ink cartridge 5 mounted to cartridge mounting portion 7, and detecting the position of the ink surface in ink cartridge 5 mounted to cartridge mounting portion 7.

Figure 7A:
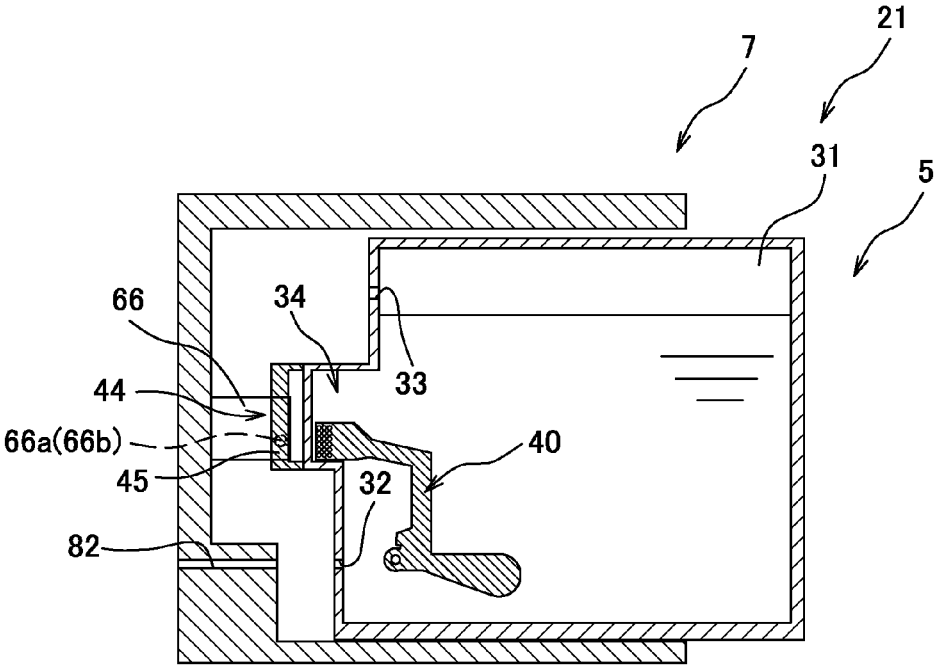
FIG. 7A is a vertical cross-sectional view of the ink cartridge and the cartridge mounting portion of FIG. 2 in which the ink cartridge is mounting to the cartridge mounting portion.
Figure 7B:
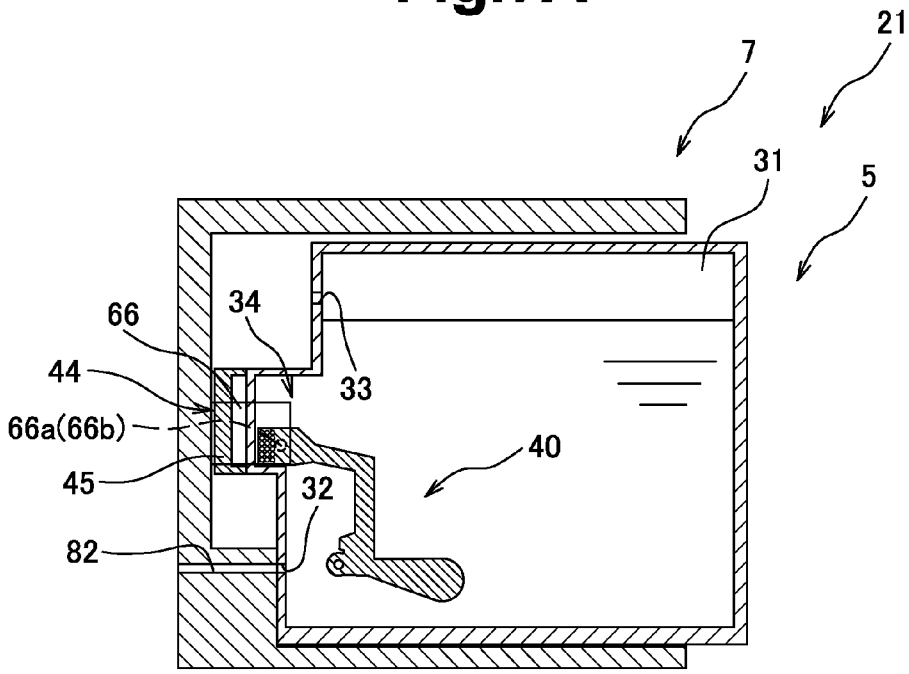
FIG. 7B is a vertical cross-sectional view of the ink cartridge and the cartridge mounting portion of FIG. 2, in which the ink cartridge is mounted to the cartridge mounting portion.

Referring to FIGS. 7A and 7B, when ink cartridge 5 is inserted into cartridge chamber 80 of cartridge mounting portion 7, cartridge main body 30 may contact projecting portion 81*a* of front wall 81, and the ink tube may be inserted into ink supply hole 32. The insertion of the ink tube into ink supply hole 32 may bring ink outlet 82 into communication with ink chamber 31 through the ink tube and the mounting of ink cartridge 5 to cartridge mounting portion 7 may be completed. Air inlet hole 33 formed in cartridge main body 30 may be open and air may be introduced through air inlet hole 33 into ink chamber 31. Ink stored in ink chamber 31 may be supplied through ink supply hole 32 to ink outlet 82 of holder 10.

During the mounting of ink cartridge 5 to cartridge mounting portion 7, light blocking plate 45 of light blocking member 44 may pass between light emitting portion 66*a* and light receiving portion 66*b* of optical sensor 66. When the mounting is completed, detection portion 34 may be positioned between light emitting portion 66*a* and light receiving portion 66*b*.

Figure 8A:
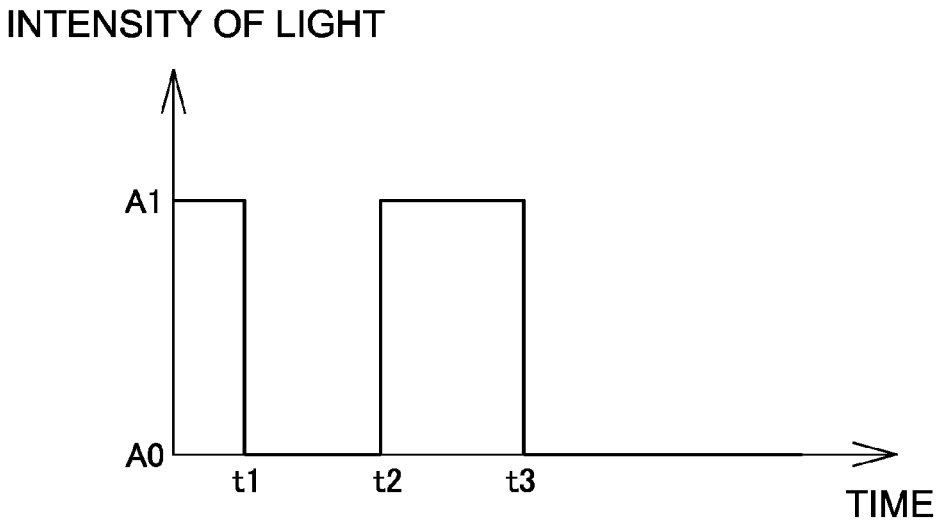
FIG. 8A is a graph illustrating a change in intensity of light received by the light receiving portion during a mounting of the first cartridge to the cartridge mounting portion.
Figure 8B:
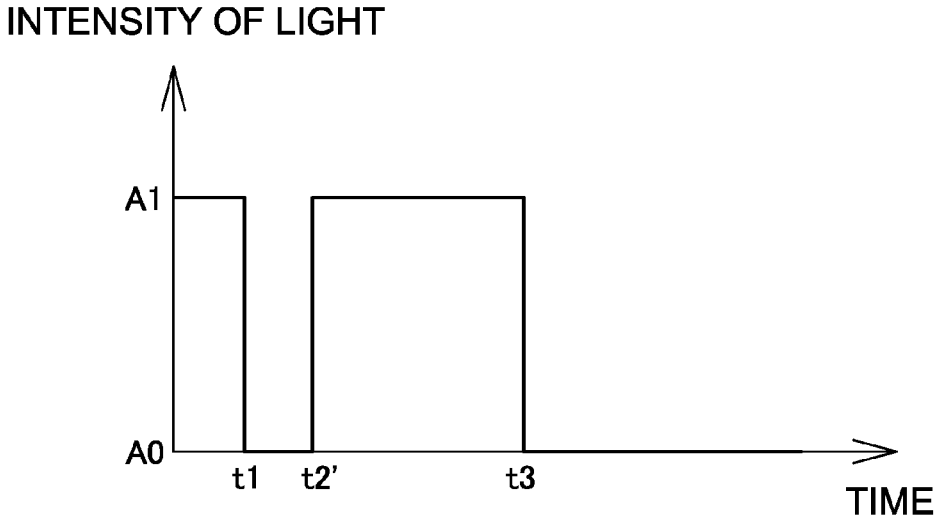
FIG. 8B is a graph illustrating a change in intensity of light received by the light receiving portion during a mounting of the second cartridge to the cartridge mounting portion.

Referring to FIGS. 8A and 8B, when light blocking plate 45 of light blocking member 44 temporarily blocks light emitted from light emitting portion 66*a*, as shown in FIG. 7A, the intensity of light received by light receiving portion 66*b* may change from A1 to A0 at time t1 and then returns to A1 at time t2 as shown in FIG. 8A. Based on this intensity change, the controller 8 may be configured to detect the mounting of ink cartridge 5 in cartridge mounting portion 7. The period of time during which light blocking plate 45 blocks light may be substantially proportional to the thickness of light blocking plate 45. The period of time during which light blocking plate 45*b* of second cartridge 5*b* blocks light, e.g., the period of time from t1 to t2', as shown in FIG. 8B, may be less than the period of time during which light blocking plate 45*a* of the first cartridge 5*a* blocks light, e.g., the period of time from t1 to t2, as shown in FIG. 8A. Based on this difference in the period of time in which the intensity is A0, controller 8 may determine the type of ink cartridge 5 mounted to cartridge mounting portion 7. Ink cartridge 5 may be mounted to cartridge mounting portion 7 automatically by an automatic mounting mechanism to increase the accuracy of determination of the type of ink cartridge 5.

Referring to FIG. 7B, when a new ink cartridge 5, e.g., an ink cartridge 5 which has never even been used before, is mounted to cartridge mounting portion 7, light blocking plate 40*c* may contact the bottom surface of detection portion 34 and may completely block light emitted from light emitting portion 66*a*, thus, the intensity of light received by light receiving portion 66*b* may be A0. As such, the intensity of light received by light receiving portion 66*b* may change from A1 to A0 at time t3, as shown in FIGS. 8A and 8B. Based on this change, controller 8 may determine that ink cartridge 5 stores a sufficient amount of ink, e.g., an amount of ink greater than an amount of ink when float 40*b* emerges from the ink surface.

Referring to FIG. 9, controller 8 of printer 1 may comprise, for example, a CPU (Central Processing Unit), a ROM (Random Access Memory) that stores various programs and data for controlling the overall operation of printer 1, a RAM (Random Access Memory) that temporarily stores, for example, data to be processed in the CPU, and a nonvolatile memory that retains data when printer 1 is powered off, e.g., an EEPROM (Electrically Erasable and Programmable Read Only Memory). The programs stored in the ROM may be executed by the CPU, and various processes may be performed. In another embodiment of the invention, controller 8 may be a hardware-like one such that various circuits comprising arithmetic circuits may be combined.

Controller 8 may be configured to function as one or more of a recording controller 50, a level detector 51, a cartridge detector 52, a memory 53, a determiner 54, a consumption estimator 55, and a calculator 56.

When controller 8 receives data from a PC 70 with an image or the like to be recorded, controller 8, as recording controller 50, may control inkjet head 3, carriage drive motor 19 configured to drive carriage 2, paper feed motor 27, and paper output motor 28 of conveying mechanism 6, to record a desired image or the like on recording sheet P.

Based on a signal output from optical sensor 60 according to the intensity of light received by light receiving portion 66*b*, controller 8, as level detector 51, may detect the position of the ink surface in ink cartridge 5 to be at one of at least three ink surface levels. The position of the ink surface detected by level detector 51 may be displayed as a message or a graphic image on a display portion 72 of printer 1 or a display of external PC 70 connected to controller 8 so as to provide a user with an indication of the remaining amount of ink in ink cartridge 5. Based on the signal output from optical sensor 60, controller 8, as cartridge detector 52, may detect the mounting of ink cartridge 5 in cartridge mounting portion 7, and may determine the type of ink cartridge 5 mounted to cartridge mounting portion 7. Controller 8, as memory 53, may functions as a nonvolatile memory and may store and update the position of the ink surface detected by level detector 51. The position of the ink surface stored in memory 53 may be retained without being deleted when printer 1 is powered off and is powered on again. Powering off printer 1 may include the steps of turning a switch 74 of printer 1 off and/or disconnecting a power plug of printer 1 from a power source. The position of the ink surface stored in memory 53 may be reset when ink cartridge 5 is replaced while printer 1 is powered on.

When printer 1 is powered on, controller 8, as determiner 54, may determine whether or not printer 1 is in an abnormal state based on a change of the position of the ink surface that is detected by level detector 51 from the position of the ink surface stored in memory 53. When printer 1 is power on after being powered off, controller 8, as determiner 54, may compare the position of the ink surface detected by level detector 51 after printer 1 is powered on with the position of the ink surface stored in memory 53, and may determine whether printer 1 is in the abnormal state based on a change of the position of the ink surface. Moreover, controller 8, as determiner 54, may determine whether an amount of ink calculated by calculator 56 is less than a predetermined minimal amount, e.g., a substantially small amount greater zero.

Controller 8, as consumption estimator 55, may estimate an amount of ink consumed, e.g., ejected, by inkjet head 3, based on an image data or the like to be recorded input from PC 70. The amount of ink consumed by inkjet head 3 may comprise not only an amount of ink ejected onto recording sheet P during printing operations but also an amount of ink consumed in operations other than the printing operation, e.g., an amount of ink consumed in purge operations of inkjet head 3 by a maintenance mechanism or an amount of ink consumed in flushing operations of inkjet head 3 performed during the printing operation or before or after the printing operation.

When controller 8, as level detector 51, detects that the position of the ink surface in ink cartridge 5 has reached the lowest ink surface level, controller 8, as calculator 56, may perform a soft count of the amount of ink in which controller 8 may calculate an amount of ink stored in ink cartridge 5 by subtracting the consumed amount of ink estimated by consumption estimator 55 from a predetermined amount of ink stored in the ROM in advance. The predetermined amount of ink may correspond to an amount of ink stored in ink cartridge 5 slightly below a border between the lowest ink surface level and a second lowest ink surface level. The calculated amount of ink may be used for displaying how much ink is remaining in ink cartridge 5 on display portion 72 or the display of PC 70 so as to provide a user with an indication of the remaining amount of ink in ink cartridge 5.

Figure 10:
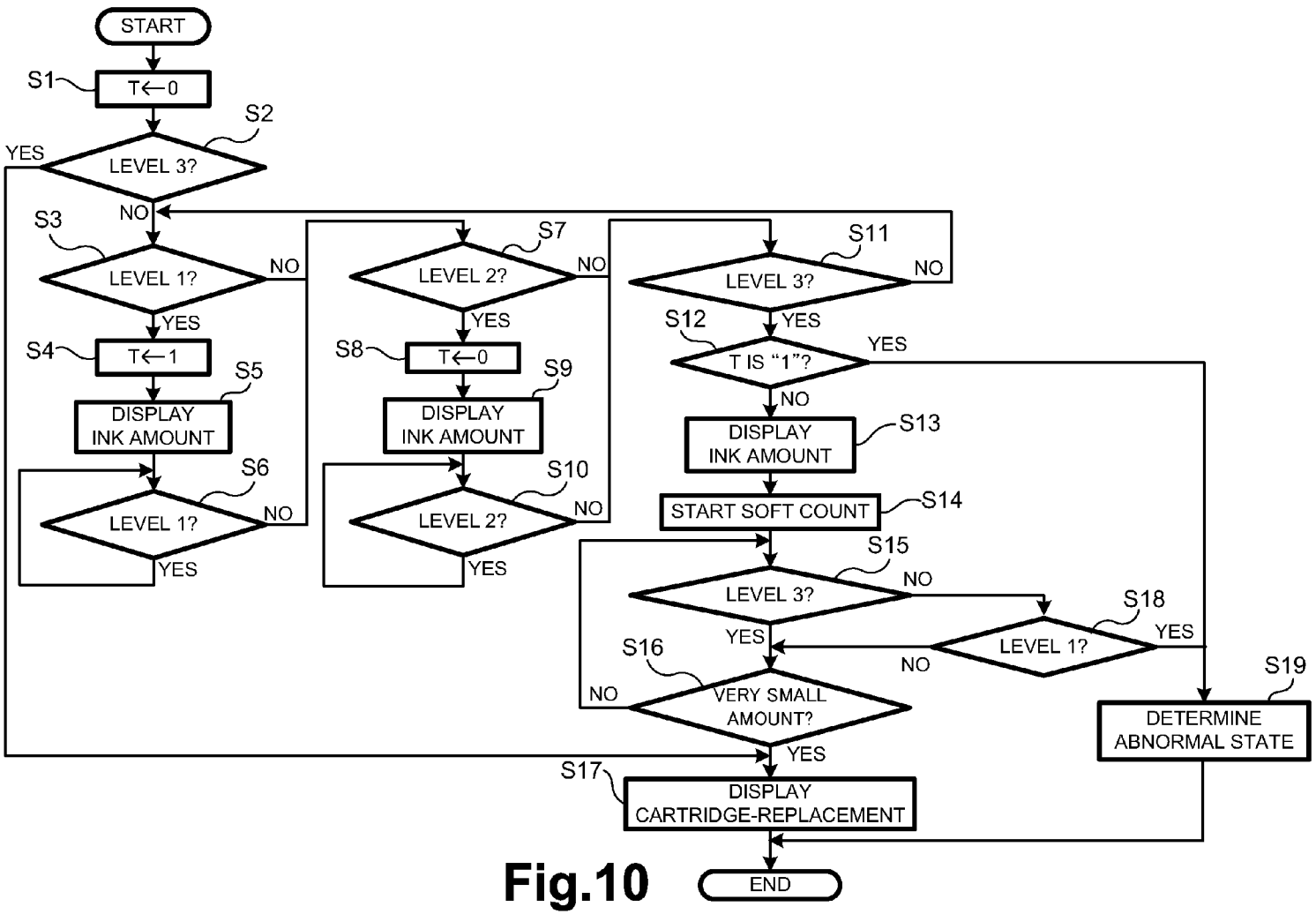
FIG. 10 is a flowchart of a method for determination of an abnormal state of the printer based on the detection of a liquid surface level, according to an embodiment of the invention.

Referring to FIG. 10, printer 1 may be determined to be in the abnormal state when the position of the ink surface detected by level detector 51 has moved by two ink surface levels, e.g., the position of the ink surface has moved by two ink surface levels in an upward direction away from the bottom surface of ink chamber 31, or has moved by two ink surface levels passing over an intermediate ink surface level, e.g., the position of the ink surface has moved by two ink surface levels passing by the intermediate ink surface level without detecting the position of the ink surface at the intermediate ink surface level. Printer 1 may be determined not to be in the abnormal state when the position of the ink surface detected by level detector 51 has moved by one liquid surface level. When printer 1 is in the abnormal state, continued use of the printer 1 may cause problems, and ink cartridge 5 may need to be inspected, removed, or replaced.

Level detector 51 may detect the position of the ink surface to be at level 1 when the intensity of light received by the light receiving portion 66*b* is A0, as shown in FIGS. 4A and 5, may detect the position of the ink surface to be at level 2 when the intensity of light received by light receiving portion 66*b* is A2, as shown in FIGS. 4B and 5, and may detect the position of the ink surface to be at level 3 when the intensity of light received by light receiving portion 66*b* is A1, as shown in FIGS. 4C and 5. Therefore, the position of the ink surface in ink cartridge 5 may move down in the order of level 1, level 2, and level 3. More specifically, the intensity of light received by the light receiving portion 66*b* may be greater than A0 but less than A2 or the intensity may be greater than A2 but less than A1. Accordingly, level detector 51 may detect the position of the ink surface to be at level 1 when the intensity of light received by light receiving portion 66*b* is greater than or equal to A0 but less than (A0+A2)/2, may detect the position of the ink surface to be at level 2 when the intensity of light received by light receiving portion 66*b* is greater than or equal to (A0+A2)/2 but less than (A2+A1)/2, and may detect the position of the ink surface to be at level 3 when the intensity of light received by light receiving portion 66*b* is greater than or equal to (A2+A1)/2. The amount of ink stored in ink chamber 31 may be greater than a predetermined first ink-amount when the position of the ink surface is detected to be at level 1. The amount of ink stored in the ink chamber 31 may be less than or equal to the first ink-amount and greater than or equal to a predetermined second ink-amount which is less than the first ink-amount when the position of the ink surface is detected to be at level 2. Moreover, the amount of ink stored in the ink chamber 31 may be less than the second ink-amount when the position of the ink surface is detected to be at level 3. The amount of ink consumed by inkjet head 3 per one consuming operation, e.g., one printing operation, one purging operation, or one flushing operation, may be less than the difference between the maximum amount of ink detected to be level 2 and the minimum amount of ink detected to be level 2. The amount of ink consumed by inkjet head 3 per one consuming operation may be less than the difference between the first ink-amount and the second ink-amount. After every consuming operation performed by inkjet head 3, the position of the ink surface may be detected by level detector 51 and may be stored in memory 53. A consuming operation may be one of a printing operation, a purging operation, and a flushing operation.

Referring to FIG. 10, in step S1, when the mounting of ink cartridge 5 to cartridge mounting portion 7 is detected, "0" may be stored in the RAM of controller 8 as a value T. Based on the position of the ink surface that is detected by level detector 51 and is subsequently stored in memory 53, determiner 54 may determine whether the position of the ink surface is at level 3. If determiner 54 determines that the position of the ink surface is at level 3, e.g., "YES" in step S2, ink cartridge 5 may be in a near-empty state or a completely empty state. In step S17, a message that ink cartridge 5 should be replaced may be displayed on display portion 72 or on the display of PC 70.

If determiner 54 determines that the position of the ink surface is not at level 3, e.g., "NO" in step S2, determiner 54 may determine whether the position of the ink surface is at level 1 in step S3. If the position of the ink surface is determined to at be level 1, e.g., "YES" in step S3, "1" may be stored in the RAM as value T in step S4, a message or graphic notifying that a sufficient amount of ink is remaining in the ink cartridge 5 may be displayed on display portion 72 or on the display of PC 70 in step S5, and determiner 54 may repeatedly determine whether the position of the ink surface is at level 1 in step S6.

If determiner 54 determines the ink surface level is not level 1, e.g., "NO" in step S3 or step S6, then determiner 54 may determine whether the position of the ink surface is at level 2 in step S7. If the position of the ink surface is determined to be at level 2, e.g., "YES" in step S7, "0" may be stored in the RAM as value T in step S8, a message or graphic notifying that a medium amount of ink is remaining in ink cartridge 5 may be displayed on display portion 72 or on the display of PC 70 in step S9, and determiner 54 may repeatedly determine whether the position of the ink surface is at level 2 in step S10.

If determiner 54 determines that the position of the ink surface is not at level 2, e.g., "NO" in step S7 or step S10, then determiner 54 may determine whether the position of the ink surface is at level 3 in step S11. If determiner 54 determines that the position of the ink surface is not at level 3, e.g., "NO" in step S11, then the process flow may return to step S3. If determiner 54 determines that the position of the ink surface is at level 3, e.g., "YES" in step S11, then determiner 54 may determine whether value T is "1" in step S12. If determiner 54 determines that value T is "1," e.g., "YES" in step S12, determiner 54 may determine that the position of the ink surface has moved downward toward the bottom surface of ink chamber 31 by two levels from level 1 to level 3 passing by level 2 without detecting the position of the ink surface at level 2, e.g., the position of the ink surface has moved by two ink surface levels passing by an intermediate ink surface level.

The downward movement of the position of the ink surface by two levels passing by level 2 may be attributed, for example, to ink leakage from the interface between ink supply hole 32 of ink cartridge 5 and ink outlet 82 of cartridge mounting portion 7 which may cause the decrease in the ink amount faster than the estimated amount of ink consumed by inkjet head 3. Leaked ink may contaminate the inside and surroundings of printer 1. The downward movement of the ink surface by two levels passing by level 2 also may be attributed to the movement of light blocking plate 40*c* relative to light emitting portion 66*a* and light receiving portion 66*b* when printer 1 is tilted. If printer 1 is tilted, the amount of ink stored in ink cartridge 5 may be incorrectly detected and ink cartridge 5 may be determined to be empty even though it actually is not empty, and a user may be required to replace the ink cartridge 5.

Determiner 54 may determine that printer 1 is in the abnormal state in step S19, and may cause, for example, display portion 72 or the display of PC 70 to display an error message that a user should check for ink leakage from ink cartridge 5 and check whether printer 1 is tilted. Therefore, printer 1 may be prevented from continuing to be used in the abnormal state.

If determiner 54 determines that value T is not "1", e.g., "NO" in step S12, a message or a graphic image notifying that ink cartridge 5 is in the near empty state may be displayed in step S13. Calculator 56 may start the soft count in step S14. Subsequently, determiner 54 may determine whether the position of the ink surface is at level 3 in step S15. If determiner 54 determines that the position of the ink surface is level 3, e.g., "YES" in step S15, then determiner 54 may determine whether the amount of ink calculated by calculator 56 is less than the predetermined minimal amount in step S16. If determiner 54 determines that the counted amount of ink is greater than the predetermined minimal amount, e.g., "NO" in step S16, step S15 may be repeated, and the ink may continue to be consumed by inkjet head 3. If determiner 54 determines that the counted amount of ink is less than the predetermined minimal amount, e.g., "YES" in step S16, the amount of ink stored in the ink cartridge 5 may be minimal, and a message prompting a user to replace ink cartridge 5 may be displayed on display portion 72 or on the display of PC 70 in step S17.

After determiner 54 determines in step S11 whether the position of the ink surface is at level 3, steps S12, S13, and S14 may be performed, and determiner 54 may determine whether the position of the ink surface is at level 3 again in step S15. If determiner 54 determines that the position of the ink surface is not at level 3, e.g., "NO" in step S15, then determiner 54 may determine whether the position of the ink surface is level 1 in step S18. If determiner 54 determines that the position of the ink surface is not at level 1, e.g., "NO" in step S18, then the process flow may go to step S16. If determiner 54 determines that the position of the ink surface is at level 1, e.g., "YES" in step S18, then determiner 54 may determine that the position of the ink surface has moved up away from the bottom surface of ink chamber 31 by two levels from level 3 to level 1. The upward movement of the position of the ink surface by two levels may be attributed, for example, to the printer 1 being tilted and light blocking plate 40*c* is moved relative to light emitting portion 66*a* and light receiving portion 66*b*. If printer 1 is tilted, the amount of ink stored in ink cartridge 5 may be incorrectly detected to be greater than it actually is, and ink cartridge 5 may be determined to contain ink even though ink cartridge 5 actually is almost empty. Consequently, air, instead of ink, may be supplied to inkjet head 3 when printing operation is continued.

Determiner 54 may determine that printer 1 is in the abnormal state in step S19, and may cause, for example, display portion 72 or the display of PC 70 to display an error message that a user should check whether printer 1 is tilted. Therefore, printer 1 may be prevented from continuing to be used in an abnormal state.

If determiner 54 determines "YES" in step S7, "NO" in step S10, and "NO" in step S11, the position of the ink surface may have moved up by one level from level 2 to level 1. In such a case, determiner 54 may perform step S3 without determining that printer 1 is in the abnormal state. If determiner 54 determines "YES" in step S11, "NO" in step S15, and "NO" in step S18, the position of the ink surface may have moved up by one level from level 3 to level 2. In such a case, determiner 54 may perform step S16 without determining that printer 1 is in the abnormal state. Similarly, if the position of the ink surface has moved down by one level from level 1 to level 2, e.g., "YES" in step S3, "NO" in step S6, and "YES" in step S7, determiner 54 may perform step S8 without determining that printer 1 is in the abnormal state. If the position of the ink surface has moved down by one step from level 2 to level 3, e.g., "YES" in step S7, "NO" in step S10, and "YES" in step S11, determiner 54 may perform step S12 without determining that printer 1 is in the abnormal state. The process flow may end after step S17 or step S19.

Two types of ink cartridges 5*a* and 5*b* having different ink-storing capacities storing different initial amounts of ink may be selectively mounted to the same cartridge mounting portion 7. The two types of ink cartridges 5*a* and 5*b* may have different ink-storing capacities and may store different initial amounts of ink because they may comprise ink chambers 31*a* and 31*b* with different lengths in the horizontal direction. As such, even if the positions of light blocking plates 40*c* in ink chambers 31*a* and 31*b* are the same, the amounts of ink stored in ink chambers 31*a* and 31*b* corresponding to the positions of light blocking plates 40*c* may be different.

For example, first cartridge 5*a* may be mounted to cartridge mounting portion 7 and printer 1 may be powered off. Then, while printer 1 is powered off, first cartridge 5*a* may be replaced with second cartridge 5*b*. When printer 1 is powered on again, printer 1 may continue to assume that first cartridge 5*a* is still mounted to cartridge mounting portion 7 because the type of ink cartridge 5 may be determined only during the mounting of ink cartridge 5 to cartridge mounting portion 7 when printer 1 is powered on. Thus, printer 1 may not recognize that ink cartridge 5 has been replaced with a different type of ink cartridge 5 while printer 1 is powered off. Depending on the type of ink cartridge 5, the amount of ink at the border between the lowest ink surface level and the second lowest ink surface level, which corresponds to the second ink-amount described above, may vary, and therefore, the amount of ink calculated by calculator 56 may also vary. Therefore, after first cartridge 5*a* is replaced with second cartridge 5*b* while printer 1 is powered off, determiner 54 may determine that an amount of ink still remains in first cartridge 5*a* although the actually-mounted second cartridge 5*b* may become empty.

Accordingly, the determination of the abnormal state of printer 1 may be performed after printer 1 is powered on after being powered off. Determiner 54 may compare the position of the ink surface in ink cartridge 5 detected by level detector 51 after printer 1 is powered on after being powered off with the position of the ink surface stored in memory 53, and may determine that printer 1 is in the abnormal state if the position of the ink surface detected after printer 1 is powered on has moved up or moved down by two ink surface levels from the position of the ink surface stored in memory 53. Determiner 54 may determine that printer 1 is not in the abnormal state if the position of the ink surface detected after printer 1 is powered on has moved up or moved down by one ink surface level from the position of the ink surface stored in memory 53. Memory 53 may be a nonvolatile ROM, which may retain the position of the ink surface when printer 1 is powered off.

If the position of the ink surface has moved up or moved down by two ink surface levels, the probability that printer 1 is in the abnormal state may be high, including the probability that ink cartridge 5 has been replaced while printer 1 is powered off. During a period after printer 1 is powered off and before the printer 1 is powered on again, ink is not supplied from ink cartridge 5, and therefore the position of the ink surface may hardly change, unless ink cartridge 5 is in the abnormal state, e.g., unless ink cartridge 5 has been replaced. However, if the amount of ink stored in ink cartridge 5 is close to a border between two different ink surface levels, and if the temperature of ink cartridge 5 rises, bubbles generated in ink may expand. The expanded bubbles may move the ink surface, and it may be determined that the position of the ink surface is moving up or moving down. If vibration is applied to printer 1 or if vibration is generated during the movement of carriage 2, the vibration may cause the ink surface to move, and it may be determined that the position of the ink surface is moving up or moving down. As such, the position of the ink surface detected by level detector 51 may change by one ink surface level. Even if the position of the ink surface detected by level detector 51 moves up or moves down by one ink surface level, printer 1 may not be in the abnormal state. Accordingly, in the determination of the abnormal state when printer 1 is powered on after being powered off, printer 1 may be determined to be the abnormal state if the position of the ink surface has moved up or moved down by two ink surface levels, but may be determined not to be in the abnormal state if the position of the ink surface has moved up or moved down by one ink surface level. If printer 1 is determined to be the abnormal state, determiner 54 may cause display portion 72 or the display of PC to display an error message indicating that a user should check for ink leakage from ink cartridge 5, check whether printer 1 is tilted, and whether ink cartridge 5 has been replaced while printer 1 is powered off. As such, printer 1 may be prevented from continuing to be used in the abnormal state.

Printer 1 may be determined to be in the abnormal state if the position of the ink surface in ink cartridge 5 detected by level detector 51 has moved up away from the bottom surface of ink chamber 31 by two ink surface levels or has moved down toward the bottom surface of ink chamber 31 by two ink surface levels passing by an intermediate ink surface level. Printer 1 may be determined not to be in the abnormal state if the position of the ink surface in ink cartridge 5 detected by level detector 51 has moved up or moved down by one ink surface level. When printer 1 is powered on after being powered off, printer 1 may be determined to be in the abnormal state if the position of the ink surface in ink cartridge 5 detected by level detector 51 has moved up by two ink surface levels or has moved down by two ink surface levels, and printer 1 may be determined not to be in the abnormal state if the position of the ink surface in ink cartridge 5 detected by level detector 51 has moved up or moved down by one ink surface level. Printer 1 may be determined not to be in the abnormal state if the position of the ink surface has moved up or moved down by one ink surface level, because the position of the ink surface may be incorrectly detected to move up or move down by one ink surface level due to the bubbles expanding in the ink in rising temperature or vibration.

In another embodiment of the invention, printer 1 may be determined to be in the abnormal state if the position of the ink surface in ink cartridge 5 detected by level detector 51 has moved up by two ink surface levels, and printer 1 may be determined not to be in the abnormal state if the position of the ink surface in ink cartridge 5 detected by level detector 51 has moved down by two ink surface levels passing by an intermediate level, e.g., Step S12 in FIG. 10 may be omitted. In yet another embodiment of the invention, printer 1 may be determined not to be in the abnormal state if the position of the ink surface in ink cartridge 5 detected by level detector 51 has moved up by two liquid surface levels, and printer 1 may be determined to be in the abnormal state if the position of the ink surface in ink cartridge 5 detected by level detector 51 has moved down by two ink surface levels passing by an intermediate level, e.g., Step S18 in FIG. 10 may be omitted.

The amount of ink consumed in inkjet head 3 in one consuming operation, e.g., one printing operation, one purging operation, or one flushing operation, may be less than the difference between the maximum amount of ink detected to be level 2, e.g., the first ink amount, and the minimum amount of ink detected to be level 2, e.g., the second ink amount. As such, one consuming operation may not cause the position of the ink surface to move down from level 1 to level 3 passing by level 2. In another embodiment of the invention, depending on the specification of printer 1, the amount of ink consumed in one consuming operation may be greater than the difference between the maximum amount of ink detected to be level 2, e.g., the first ink amount, and the minimum amount of ink detected to be level 2, e.g., the second ink amount. As such, one consuming operation may cause the position of the ink surface to move down from level 1 to level 3 passing by level 2, and therefore it cannot be distinguished whether the printer 1 is in the abnormal state or ink is simply consumed. Therefore, if the amount of ink consumed in one consuming operation is greater than the difference between the maximum amount of ink detected to be level 2, e.g., the first ink amount, and the minimum amount of ink detected to be level 2, e.g., the second ink amount, in step S12 of FIG. 10, determiner 54 may determine whether value T is "1" and may also determine whether the amount of ink consumed in a previous consuming operation estimated by consumption estimator 55 is greater than the difference between the maximum amount of ink detected to be level 2 and the minimum amount of ink detected to be level 2. If value T is not "1" in step S12, then the process flow may go to step S13. If value T is "1" and if the amount of ink consumed in the previous consuming operation estimated by consumption estimator 55 is greater than or equal to the difference between the maximum amount of ink detected to be level 2 and the minimum amount of ink detected to be level 2, then the process flow may go to step S13. If value T is "1" and if the amount of ink consumed in the previous consuming operation estimated by consumption estimator 55 is less than the difference between the maximum amount of ink detected to be level 2 and the minimum amount of ink detected to be level 2, then the process flow may go to step S19.

In the flowchart of FIG. 10, determiner 54 may determine that printer 1 is in the abnormal state without distinguishing between the case in which the position of the ink surface has changed from level 3 to level 1 passing by level 2 and the case in which the position of the ink surface has changed from level 3 to level 2, and then to level 1. As such, printer 1 may be determined to be in the abnormal state, regardless of whether level 2 has been passed by. After the soft count is started in step S14, steps may be repeated in the order of step S15, step S18, and step S16 for as long as the position of the ink surface is at level 2. In another embodiment of the invention, determiner 54 may distinguish the case in which the position of the ink surface has changed from level 3 to level 1 passing by level 2 and the case in which the position of the ink surface has changed from level 3 to level 2, and then to level 1, without passing by level 2.

Level detector 51 may detect the position of the ink surface after every consuming operation by inkjet head 3. In another embodiment of the invention, the position of the ink surface may be detected at any time. The interval of detection by level detector 51 may be set, such that the amount of ink consumed by the inkjet head 3 during the interval of detection is less than the difference between the maximum amount of ink detected to be level 2, e.g., the first ink amount, and the minimum amount of ink detected to be level 2, e.g., the second ink amount.

The position of ink surface in ink cartridge 5 may be detected in three ink surface levels. In another embodiment of the invention, the number of ink surface levels may be more than three. As such, determiner 54 may determine that printer 1 is in the abnormal state if the position of the ink surface in ink cartridge 5 detected by level detector 51 has moved up by two or more liquid surface levels or has moved down by two or more liquid surface levels passing by an intermediate level or intermediate levels, and determiner 54 may determine that printer 1 is not in the abnormal state if the position of the ink surface in ink cartridge 5 detected by level detector 51 has moved down or moved up by one ink surface level.

Figure 11A:
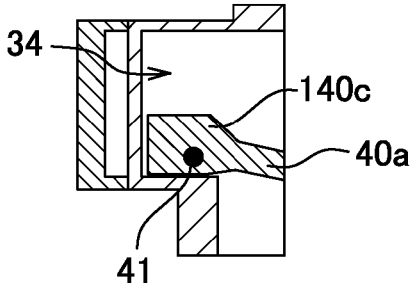
FIG. 11A is an enlarged view of a portion of an ink cartridge corresponding to FIG. 4A-4C, according to another embodiment of the invention, in which an ink surface is positioned above a float
Figure 11B:
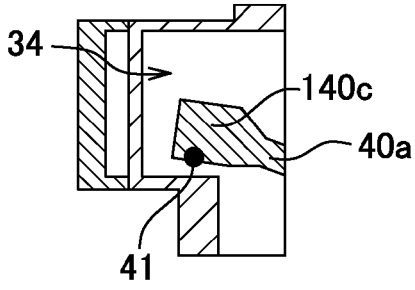
FIG. 11B is the enlarged view of FIG. 11A, in which the float emerges from the ink surface and a light blocking plate moves slightly
Figure 11C:
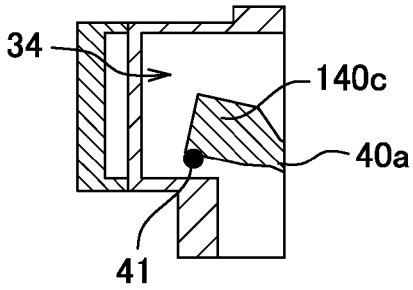
FIG. 11C is the enlarged view of FIG. 11A, in which the light blocking plate moves further beyond the position of the light blocking plate in FIG. 11B.
Figure 11D:
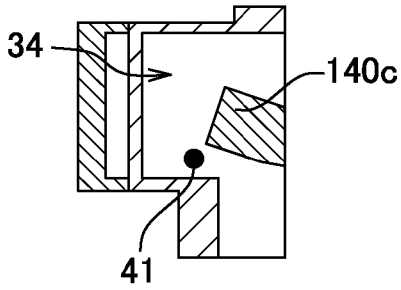
FIG. 11D is the enlarged view of FIG. 11A, in which and the light blocking plate moves further beyond the position of the light blocking plate in FIG. 11C.
Figure 12:
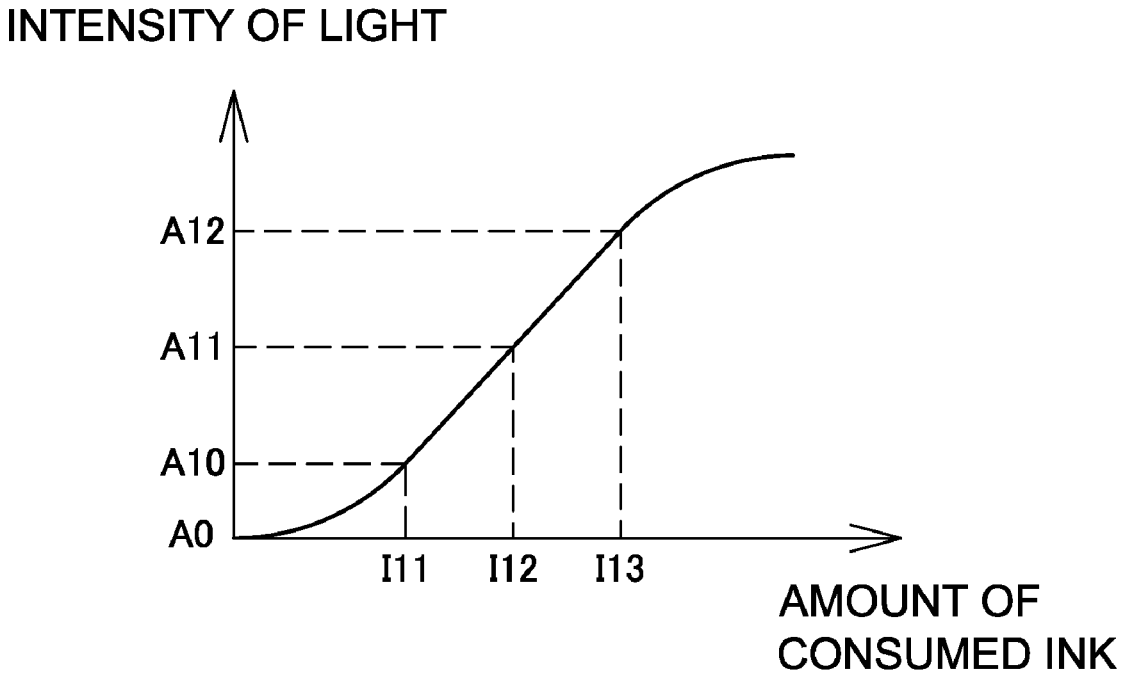
FIG. 12 is a graph illustrating a change in intensity of light received by the light receiving portion when the light blocking plate of FIGS. 11A-11D moves relative to the light emitting port of the light emitting portion.

Referring to FIGS. 11A-12, the position of the ink surface in ink cartridge 5 may be detected using a light blocking plate 140*c* without opening-formed portion 40*d*. The position of light blocking plate 140*c* may change when the amount of ink in ink cartridge 5 decreases in an order, as shown in FIGS. 11A, 11B, 11C, and 11D. Referring to FIG. 12, the intensity of light received by light receiving portion 66*b* of optical sensor 66 may change continuously. The intensity of light may be divided into four intensity levels: grater than or equal to A0 but less than A10, greater than or equal to A10 but less than A11, greater than or equal to A11 but less than A12, and greater than or equal to A12. The position of the ink surface in ink cartridge 5 may be divided into four ink surface levels corresponding to these intensity levels. Level detector 51 may detect the position of the ink surface to be at level 1 when the intensity of light received by light receiving portion 66*b* is greater than or equal to A0 but less than A10, may detect the position of the ink surface to be at level 2 when the intensity of light received by light receiving portion 66*b* is greater than or equal to A10 but less than A11, may detect the position of the ink surface to be at level 3 when the intensity of light received by light receiving portion 66*b* is greater than or equal to A11 but less than A12, and may detect the position of the ink surface to be at level 4 when the intensity of light received by light receiving portion 66*b* is greater than or equal to A12. The position of the ink amount detected by the level detector may be stored in memory 53.

Figure 13:
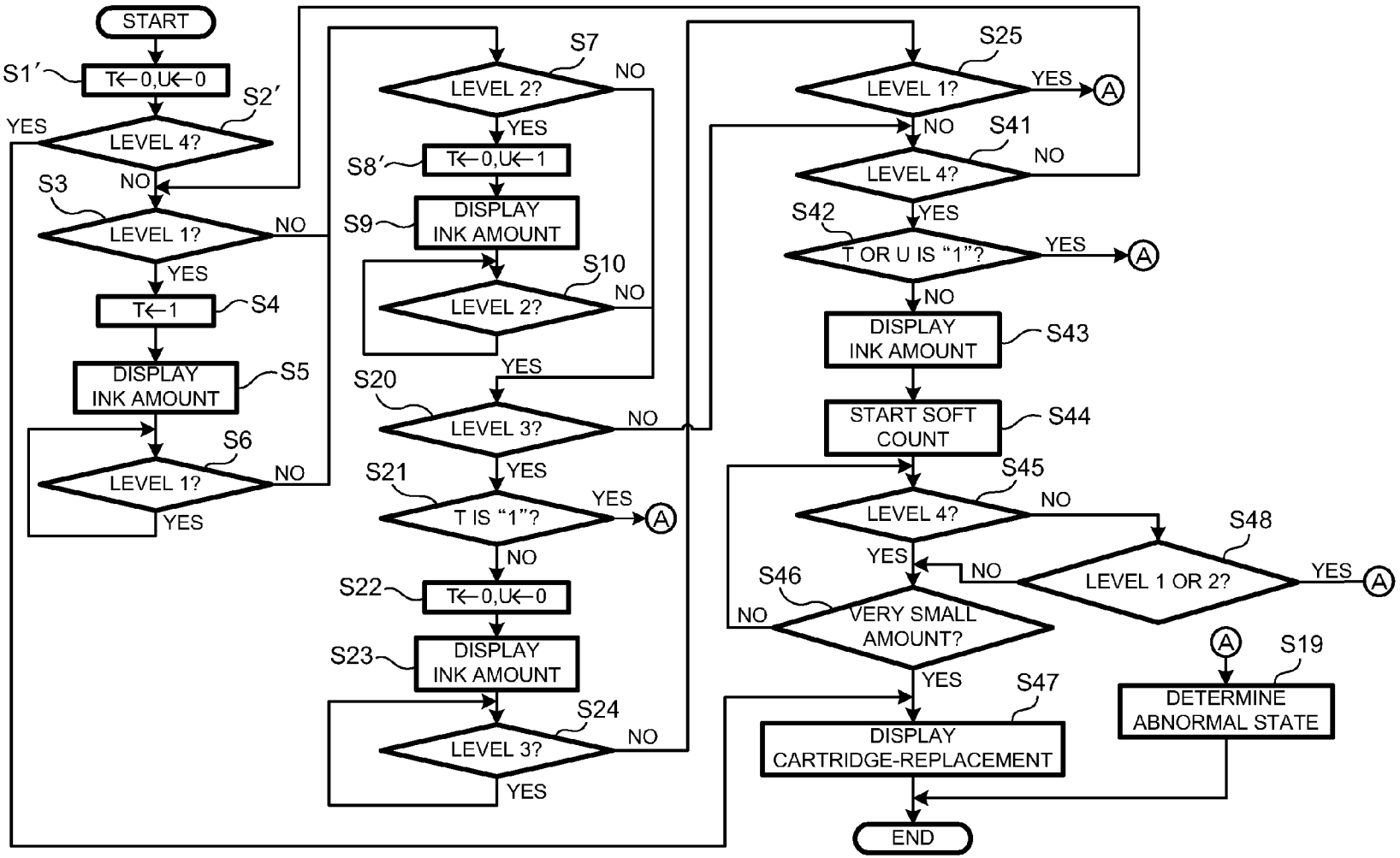
FIG. 13 is a flowchart of a method for determination of an abnormal state of the printer based on the detection of a liquid surface level, according to another embodiment of the invention.

Referring to FIG. 13, a value "0" may be stored in the RAM as values T and U in step S1'. Then, similarly to the flowchart of FIG. 10, steps S2' to S7 and steps S8' to S10 may be performed. If determiner 54 determines that the position of the ink surface is not at level 2, "NO" in step S7 or step S10, then determiner 54 may determine whether the position of the ink surface is at level 3 in step S20. In step S2', it is determined whether the position of the ink surface is level 4. In S8', a value "0" may be stored in the RAM as value T, and a value "1" may be stored in the RAM as value U.

If determiner 54 determines that the position of the ink surface is at level 3, e.g., "YES" in step S20, then determiner 54 may determine whether value T is "1" in step S21. If determiner 54 determines that value T is "1," e.g., "YES" in step S21, determiner 54 may determine that the position of the ink surface has moved down by two levels from level 1 to level 3 passing by level 2, i.e., the position of the ink surface has moved down by two ink surface levels passing by an intermediate level without detecting the position of the ink surface at the intermediate level, and may determine that printer 1 is in the abnormal state in step S19.

If determiner 54 determines that value T is not "1," e.g., "NO" in step S21, steps S22 to S24 may be performed. If determiner 54 determines that the position of the ink surface is not at level 3, e.g., "NO" in step S24, then determiner 54 may determine whether the position of the ink surface is at level 1 in step S25. If determiner 54 determines that the position of the ink surface is at level 1, e.g., "YES" in step S25, then determiner 54 may determine that the position of the ink surface has moved up by two liquid surface levels from level 3 to level 1, and may determine that printer 1 is in the abnormal state in step S19.

If determiner 54 determines that the position of the ink surface is not at level 1, e.g., "NO" in step S25, or if determiner 54 determines that the position of the ink surface is not at level 3, e.g., "NO" in step S20, then determiner 54 may determine whether the position of the ink surface is at level 4 in step S41. If determiner 54 determines that the position of the ink surface is not at level 4, e.g., "NO" in step S41, then the process flow may return to step S3. If determiner 54 determines that the position of the ink surface is at level 4, e.g., "YES" in step S41, then determiner 54 may determine whether value T or value U is "1" in step S42. If determiner 54 determines that value T or value U is "1," e.g., "YES" in step S42, determiner 54 may determine that the position of the ink surface has moved down by three levels from level 1 to level 4 passing by level 2 and level 3, e.g., the position of the ink surface has moved down by three ink surface levels passing by intermediate levels without detecting the position of the ink surface at the intermediate levels or may determine that the position of the ink surface has moved down by two levels from level 2 to level 4 passing by level 3, e.g., the position of the ink surface has moved down by two ink surface levels passing by an intermediate level without detecting the position of the ink surface at the intermediate level, and may determine that printer 1 is in the abnormal state in step S19.

If determiner 54 determines that value T is not "1" and that value U is not "1," e.g., "NO" in step S42, then determiner 54 may perform steps S43 and S44 and may determine whether the position of the ink surface is at level 4 in step S45. If determiner 54 determines that the position of the ink surface is at level 4, e.g., "YES" in step S45, then determiner 54 may perform step S46. If determiner 54 determines that the position of the ink surface is not at level 4, e.g., "NO" in step S45, then determiner 54 may determine whether the position of the ink surface is either level 1 or level 2 in step S48. If determiner 54 determines that the position of the ink surface is neither level 1 nor level 2, e.g., "NO" in step S48, then the process flow may go to step S46. If determiner 54 determines that the position of the ink surface is either level 1 or level 2, e.g., "YES" in step S48, determiner 54 may determine that the position of the ink surface has moved up by two or more levels from level 4 to level 1 or level 2, and may determine that printer 1 is in the abnormal state in step S19. The process flow may end after step S47 or step S19.

Other factors that cause printer 1 to be determined to be in the abnormal state may include, for example, malfunction of optical sensor 66. If printer 1 is determined to be in the abnormal state, the continued use of printer 1 may cause problems.

In another embodiment of the invention, ink cartridge 5 may comprise a float which may comprise a light-blocking material. In yet another embodiment of the invention, the ink may have a light blocking property. As such, the position of the ink surface may be detected according to whether or not light emitted from optical sensor 66 is blocked by the ink itself, and ink cartridge 5 may not have movable member in ink chamber 31.

In another embodiment of the invention, ink cartridge 5 may comprise a movable member that is connected to a float configured to move according to the amount of ink stored in ink chamber 31, and the movable member may project to the outside ink cartridge 5. A mechanical sensor, e.g., a proximity sensor or a contact sensor, may detect the projecting movable member. In yet another embodiment of the invention, cartridge mounting portions 7 may comprise a Hall element, and ink cartridge 5 may comprise a magnet, and level detector 51 may detect the position of the ink surface by a magnetic flux density due to the Hall effect of the Hall element according to the positional relationship between the magnet of ink cartridge 5 and the Hall element of cartridge mounting portion 7. In still another embodiment of the invention, each of cartridge mounting portion 7 and ink cartridge 5 may comprise electric contacts, and level detector 51 may detect the position of the ink surface by measuring the electrical resistances between the electric contacts when ink cartridge 5 is mounted to cartridge mounting portion 7.

In another embodiment of the invention, cartridge mounting portion 7 may comprise a plurality of optical sensors that are configured to detect whether light is received with a predetermined intensity or more. In yet another embodiment of the invention, cartridge mounting portion 7 may comprise an optical sensor which is configured to move in the vertical direction.

In another embodiment of the invention, the detection of the mounting of ink cartridge 5 to cartridge mounting portion 7 and the determination of the type of ink cartridge 5 may be performed by using a sensor other than a sensor used for the detection of the position of the ink surface.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid supply device comprising:

a liquid cartridge comprising a liquid chamber configured to store a liquid therein;

a cartridge mounting portion, wherein the liquid cartridge is configured to removably mount to the cartridge mounting portion;

a level detector configured to detect a position of a liquid surface of the liquid stored in the liquid chamber, wherein the position of the liquid surface of the liquid is detected to be at one of at least three liquid surface levels; and a determiner configured to determine that the liquid supply device is in an abnormal state when the determiner determines that the position of the liquid surface of the liquid detected by the level detector has moved by two or more liquid surface levels in a particular direction away from a bottom surface of the liquid chamber, and the determiner is configured to determine that the liquid supply device is not in the abnormal state when the determiner determines that the position of the liquid surface of the liquid detected by the level detector has moved by one or fewer liquid surface level in the particular direction.

2. The liquid supply device of claim 1, further comprising a nonvolatile memory configured to store therein the position of the liquid surface detected by the level detector, wherein when the liquid supply device is powered on after being powered off, the determiner is configured to compare the position of the liquid surface detected by the level detector after the liquid supply device is powered on with the position of the liquid surface stored in the nonvolatile memory, and wherein the determiner is configured to determine that the liquid supply device is in the abnormal state when the determiner determines that the position of the liquid surface detected by the level detector after the liquid supply device is powered on has moved by two or more liquid surface levels in the particular direction from the position of the liquid surface stored in the non-volatile memory, and the determiner is configured to determine that the liquid supply device is not in the abnormal state when the determiner determines that the position of the liquid surface detected by the level detector after the liquid supply device is powered on has moved by one or fewer liquid surface level in the particular direction from the position of the liquid surface stored in the nonvolatile memory.

3. The liquid supply device of claim 1, wherein the determiner is configured to determine that the liquid supply device is in the abnormal state when the position of the liquid surface detected by the level detector has moved by two liquid surface levels in the particular direction consecutively.

4. The liquid supply device of claim 1, further comprising:

a liquid ejecting head configured to eject the liquid supplied from the liquid cartridge;

a consumption estimator configured to estimate an amount of the liquid consumed by the ejection of liquid from the liquid ejecting head;

a memory; and a calculator, wherein when the level detector detects that the position of the liquid surface in the liquid chamber has reached a lowest liquid surface level, the calculator is configured to calculate an amount of the liquid remaining in the liquid chamber by subtracting the estimated amount of the liquid consumed by the ejection of liquid from the liquid ejecting head after the level detector detects that the liquid surface has reached the lowest liquid surface level from a predetermined amount of the liquid stored in the memory.

5. The liquid supply device of claim 1, wherein the liquid cartridge comprises a movable member positioned in the liquid chamber and configured to move in accordance with the amount of the liquid stored in the liquid chamber, wherein the liquid supply device further comprises:

a signal emitting portion configured to emit a signal and positioned at one of the cartridge mounting portion and the movable member; and a signal receiving portion configured to receive the signal emitted from the signal emitting portion and positioned at the cartridge mounting portion, wherein an intensity of the signal received by the signal receiving portion varies based on a position of the movable member in the liquid chamber, and wherein the level detector is configured to detect the position of the liquid surface in the liquid chamber based on the intensity of the signal received by the signal receiving portion.

6. The liquid supply device of claim 1, wherein the determiner is configured to determine that the liquid supply device is in the abnormal state when the determiner determines that the position of the liquid surface detected by the level detector has moved by two or more liquid surface levels in a downward direction opposite the particular direction passing by at least one intermediate liquid surface level without detecting the position of the liquid surface at the intermediate liquid surface level, and configured to determine that the liquid supply device is not in the abnormal state when the determiner determines that the position of the liquid surface detected by the level detector has moved by one or fewer liquid surface level in the downward direction.

7. A liquid supply device comprising:

a liquid cartridge comprising a liquid chamber configured to store a liquid therein;

a cartridge mounting portion, wherein the liquid cartridge is configured to removably mount to the cartridge mounting portion;

a level detector configured to detect a position of a liquid surface of the liquid stored in the liquid chamber, wherein the position of the liquid surface of the liquid is detected to be at one of at least three liquid surface levels; and a determiner configured to determine that the liquid supply device is in an abnormal state when the determiner determines that the position of the liquid surface detected by the level detector has moved by two or more liquid surface levels passing by at least one intermediate liquid surface level in a downward direction toward a bottom surface of the ink chamber without detecting the position of the liquid surface at the at least one intermediate liquid surface level, and to determine that the liquid supply device is not in the abnormal state when the position of the liquid surface detected by the level detector has moved by one or fewer liquid surface level in the downward direction.

8. The liquid supply device of claim 7, further comprising a nonvolatile memory configured to store therein the position of the liquid surface detected by the level detector, wherein when the liquid supply device is powered on after being powered off, the determiner is configured to compare the position of the liquid surface in the liquid chamber detected by the level detector after the liquid supply device is powered on with the position of the liquid surface stored in the nonvolatile memory, and the determiner is configured to determine that the liquid supply device is in the abnormal state when the determiner determines that the position of the liquid surface detected after the liquid supply device is powered on has moved by two or more liquid surface levels in the downward direction from the position of the liquid surface stored in the nonvolatile memory, and configured to determine that the liquid supply device is not in the abnormal state when the determiner determines that the position of the liquid surface detected after the liquid supply device is powered on has moved by one or fewer liquid surface level in the downward direction from the position of the liquid surface stored in the nonvolatile memory.

9. A liquid supply device comprising:

a liquid cartridge comprising a liquid chamber configured to store a liquid therein;

a cartridge mounting portion, wherein the liquid cartridge is configured to removably mount to the cartridge mounting portion;

a level detector configured to detect a position of a liquid surface of the liquid stored in the liquid chamber, wherein the position of the liquid surface of the liquid is detected to be at one of at least three liquid surface levels; and a controller configured to perform a first process when the controller determines that the position of the liquid surface detected by the level detector has moved by two or more liquid surface levels in a particular direction away from a bottom surface of the liquid chamber and configured to perform a second process when the controller determines that the position of the liquid surface detected by the level detector has moved by one or fewer liquid surface level in the particular direction, wherein the second process is distinct from the first process.

10. The liquid supply device of claim 9, further comprising a nonvolatile memory configured to store therein the position of the liquid surface detected by the level detector, wherein after the liquid supply device is powered on after being powered off, the controller is configured to compare the position of the liquid surface in the liquid chamber detected by the level detector with the position of the liquid surface stored in the nonvolatile memory, and the controller is configured to perform the first process when the controller determines that the position of the liquid surface detected after the liquid supply device is powered on has moved by two or more liquid surface levels in the particular direction from the position of the liquid surface stored in the nonvolatile memory, and configured to perform the second process when the controller determines that the position of the liquid surface detected after the liquid supply device is powered on has moved by one or fewer liquid surface level in the particular direction from the position of the liquid surface stored in the nonvolatile memory.

* * * * *